United States Patent [19]

Isaac et al.

[11] 4,179,168

[45] Dec. 18, 1979

[54] DISPLAY DEVICE HAVING A LOCKING MECHANISM

[75] Inventors: L. Henry Isaac, Greendale; Edward J. Nowak, Cudahy; Charles R. Schmitz, Muskego, all of Wis.

[73] Assignee: Display Corporation International, Milwaukee, Wis.

[21] Appl. No.: 923,998

[22] Filed: Jul. 12, 1978

[51] Int. Cl.[2] ..... A47F 3/10

[52] U.S. Cl. ..... 312/125; 312/59; 312/202; 312/305

[58] Field of Search ..... 312/125, 135, 305, 111, 312/97.1, 202, 59

[56] References Cited

U.S. PATENT DOCUMENTS

| | | | |
|---|---|---|---|
| 234,461 | 11/1880 | Dodge | 312/305 |
| 241,123 | 5/1881 | Danner | 312/202 |
| 859,196 | 7/1907 | Boye | 312/305 |
| 1,539,296 | 5/1925 | Bundy et al. | 312/125 |
| 2,512,465 | 6/1950 | Moorhouse | 312/125 |
| 2,555,070 | 5/1951 | Wood | 312/125 |
| 2,673,778 | 3/1954 | Wood | 312/125 |
| 3,747,754 | 7/1973 | Nix et al. | 312/59 |
| 3,868,157 | 2/1975 | Robinson | 312/305 |
| 3,982,800 | 9/1976 | Gorton et al. | 312/135 |

*Primary Examiner*—Victor N. Sakran

[57] ABSTRACT

A display device including a plurality of generally vertical display racks supported to form a rectangular configuration, each of the display racks supported for rotation between a first position, wherein their front faces face outwardly for displaying the display items, and a second position wherein the front faces face inwardly such that the display racks form a closed pilfer proof configuration. The display racks are supported for simultaneous shifting between the first position and the second position and such that each of the vertical sides of the closed configuration is formed by an end wall of one of the display racks and one of the faces of an adjacent one of the display racks.

13 Claims, 4 Drawing Figures

DISPLAY DEVICE HAVING A LOCKING MECHANISM

BACKGROUND OF THE INVENTION

The invention relates to display devices and more particularly to point-of-purchase display devices which include means for preventing theft or pilferage of the contents of the display devices when they are not in use.

Point-of-purchase display racks are commonly used to merchandise items such as cigarettes. To protect such items against theft or pilferage, it is desirable that the display device include means for selectively precluding access to its contents when the display rack is not being used as a merchandising mechanism.

SUMMARY OF THE INVENTION

The invention provides an improved display device including a plurality of display racks conveniently pivotable between a first position wherein the contents of the display racks are displayed and a second position wherein the display racks form an enclosure for the merchandise supported thereon, thereby precluding access to that merchandise.

The display device of the invention includes a plurality of generally vertical display racks supported to form a closed rectangular configuration having a plurality of vertical sides, each of the display racks including a front face having means for supporting display items and a rear face. Means are provided for supporting each of the display racks for rotation between a first position, wherein the front face of each of the respective display racks faces outwardly of the rectangular configuration for displaying the display items, and a second position wherein the front face of each of the respective display racks faces inwardly of the rectangular configuration. Means are further provided for simultaneously shifting the display racks from the first position to the second position.

One of the principal features of the invention is the provision of the plurality of vertical sides of the rectangular configuration being formed by a respective end wall of one of the display racks and by a respective one of the faces of an adjacent display rack.

Another of the principal features of the invention is the provision in the means for shifting each of the display racks from the first position to the second position of a first gear surrounding a first pivot member and connected to a first one of the display racks for rotation with that display rack, a second gear surrounding a second pivot member and connected to a second one of the display racks for rotation with that display rack, and a third gear between the first gear and the second gear and in driving engagement with the first gear and the second gear.

Another of the principal features of the invention is the provision of means for locking the display racks in the second position, the locking means including means for preventing rotation of the gear with respect to the lower supporting plate.

Other features and advantages of the embodiments of the invention will become apparent to those skilled in the art upon reviewing the following detailed description, the drawings and the appended claims.

Figure 2:
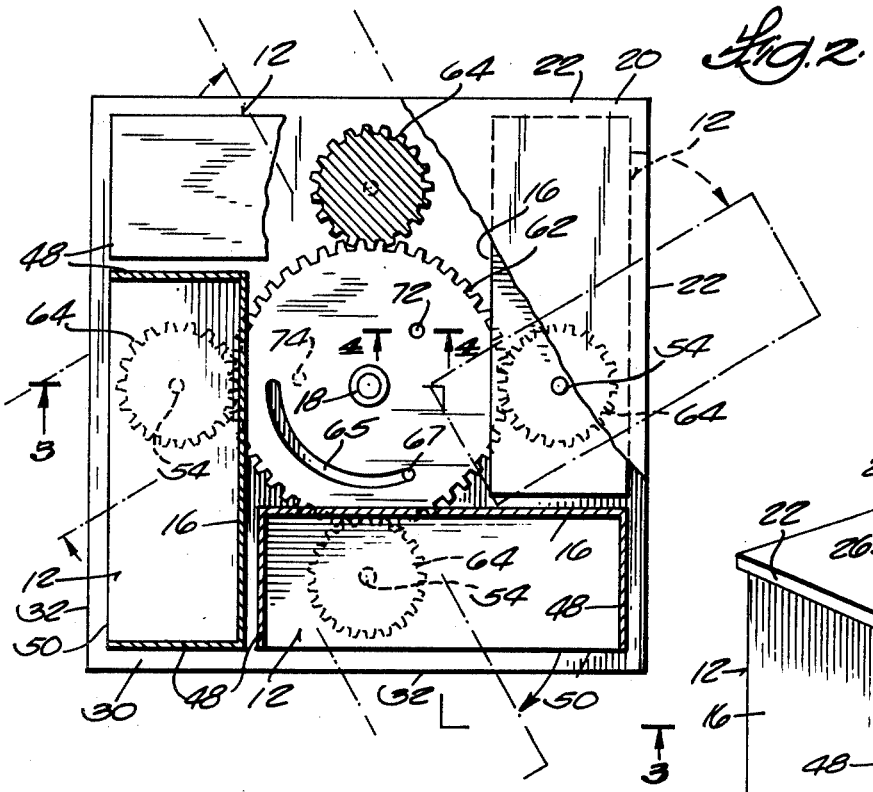
FIG. 2 is an enlarged cross section plan view of the display device shown in FIG. 1, but with the display racks of the display device pivoted such that they open outwardly.

Before explaining one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

Figure 1:
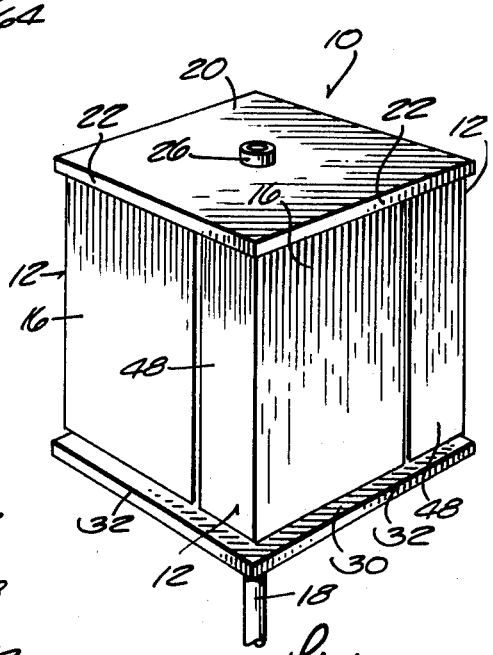
FIG. 1 is a perspective view of a display device embodying the present invention.

Illustrated in FIG. 1 is a point of purchase merchandise display device 10 including four vertically positioned display racks 12. The display racks 12 are provided with inclined trays 14 (FIG. 3) of the type for holding merchandise such as cigarettes. The four display racks 12 are supported to form a square enclosure, and they are each pivotable about a vertical axis from a first position wherein the display racks open outwardly to permit access to merchandise contained in the display racks to a second position illustrated in FIG. 1 wherein the rear walls 16 of the display racks face outwardly. In the second position, the display racks 12 form an inaccessible enclosure housing the merchandise supported by the display racks to thereby prevent pilferage or theft of that merchandise.

More particularly, the display device 10 includes a central vertical supporting pole 18 supporting an upper horizontal support plate 20 which forms a top for the display device 10. The upper support plate 20 is generally square and has four sides 22. The support plate 20 also includes a central aperture 24 for receiving the upper end of the supporting pole 18. The supporting plate 20 also includes an upwardly extending cylindrical collar 26 surrounding the aperture 24 and having a central bore 28. The display device 10 also includes a lower horizontal supporting plate 30 parallel to and spaced below the upper supporting plate 20. The lower plate 30 is also square and has four sides 32 coplanar with sides 22 of the upper support plate 20. The lower planar support plate 30 also includes a downwardly extending central cylindrical flange 36 having a bore 34.

Means are also provided for supporting the upper and lower supporting plates 20 and 30 and the display racks 12 for rotation around the vertical pole 18. An outer tube 40 surrounds the vertical pole 18 and is rotatable around the vertical pole. the outer tube 40 is supported by a collar 42 which is fixed to the pole 18 and which includes an upper surface 44 for supporting the lower end of the tube 40. The upper surface 44 of the collar 42 also supports the downwardly extending central cylindrical flange 36 of the lower plate 30. The upper end of the outer tube 40 is received against the lower surface 47 of the upper supporting plate 20 to provide support for the upper plate 20.

Figure 3:
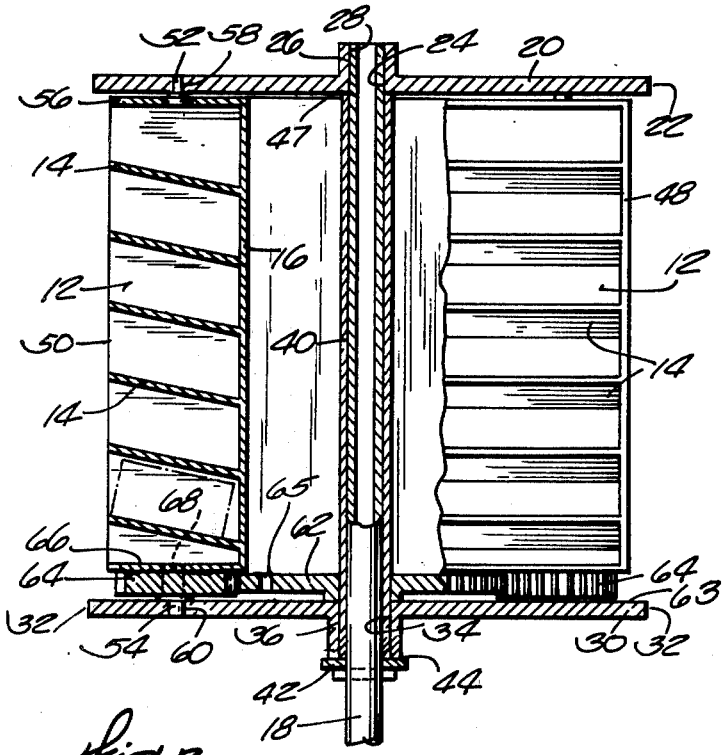
FIG. 3 is a cross section view taken along line 3—3 in FIG. 2.

The four vertical display racks 12 are supported between the upper and lower supporting plates 20 and 30, respectively, and adjacent the edges 22 and 32, respectively, of the supporting plates. The four display racks 12 each have opposite end walls 48, a front face 50 and a rear face defined by the rear wall 16. The display racks 12 are supported between the upper and lower supporting plates 20 and 30, respectively, such that, when the display racks 12 open outwardly as shown in FIGS. 2 and 3, each of the sides of the square emclosure formed by the display racks 12 is formed by a front face 50 of one of the display racks and an end wall 48 of an adjacent display rack. When the display racks 12 are pivoted such that the front faces 50 face inwardly, as shown in FIG. 1, each of the sides of the square enclosure is formed by a rear face 16 of one of the display racks and an end wall 48 of an adjacent display rack.

The display racks 12 are each supported for pivotal movement by co-axial upper and lower pivot pins 52 and 54, respectively. The upper pivot pins 52 extend upwardly from an upper wall 56 of the display racks 12 and are engaged within bores 58 in the upper support plate 20. The lower pivot pins 54 extend downwardly from the display rack 12 and are received within bores 60 in the lower plate 30. The pivot pins 52 and 54 are located such that they are equidistant the opposite ends of the sides 22 and 32, respectively, and adjacent those sides.

Means are further provided for connecting the display racks 12 for simultaneous pivotal movement between the first position wherein the display racks 12 face outwardly and the second position wherein the display racks face inwardly and form a closed configuration. In the illustrated construction, the connecting means includes a gear assembly comprised of a large central gear 62 supported adjacent the upper surface 63 of the supporting plate 30 and rotatable around the outer tube 40. The connecting means also includes a plurality of smaller gears 64 each meshing with the larger gear 62. The smaller gears 64 are rigidly attached to the lower surface of the bottom walls 66 of the display racks and include a central bore 68 housing the lower pivot pin 54.

To further explain the support arrangement of the display racks 12, each such rack is pivotally supported adjacent one end wall 48 thereof. That is, the support is adjacent one end wall in the sense that, relative to the length of the rack as viewed in FIG. 1, it is offcenter and closer to one of its two end walls. The opposite end wall, or that spaced further from the pivot moves outwardly of the basic display when each rack moves between its first and second positions.

In operation, manual rotation of one of the display racks 12 causes rotation of one of the smaller gears 64. Accordingly, that smaller gear 64 causes rotation of the larger gear 62 and consequent rotation of each of the other smaller gears 64 such that movement of one of the display racks 12 about the pivot pin 52 and 54 causes simultaneous pivotal movement of each of the other display racks 12.

Figure 4:
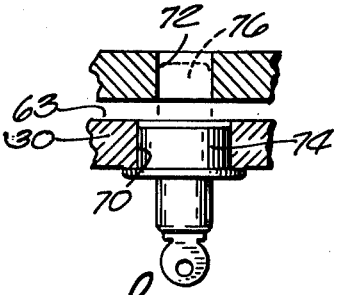
FIG. 4 is an enlarged cross section view taken along line 4—4 in FIG. 2, and with a locking assembly in an aligned lockable position.

To provide a means for limiting the pivotal movement of the display racks 12 to an arc of 180°, the larger gear 62 is provided with an arcuate slot 65 (FIG. 2) housing a fixed pin 67 extending upwardly from the lower supporting plate 30. When the pin 67 is positioned against one end of the slot 65, as shown in FIG. 2, the display racks 12 are positioned in their outwardly facing position, and when the pin 67 is positioned against the opposite end of the slot 65, the display racks 12 are positioned in inwardly facing relation.

the display device is also provided with means for locking the display racks 12 in a first position wherein the display racks face inwardly to form a closed configuration protecting the contents of the display device from pilferage or theft an a second position wherein the display racks 12 open outwardly. the lower support plate 30 includes a bore 70, spaced outwardly from the longitudinal axis of the vertical support post 18. As illustrated in FIG. 4, a lock 74 is housed within the bore 70 and includes an upwardly movable cylinder 76 selectively positionable in a bore 72 in the larger gear 62, to thereby prevent relative movement of the larger gears with respect to the bottom plate 30 when the display racks are pivoted to their closed position shown in FIG. 1. Since the display racks 12 are joined by the gears 62 and 64 for simultaneous movement, by locking the gear 62 against rotation with respect to the lower support plate 30, all of the display racks 12 are locked in place.

Various of the features of the invention are set forth in the following claims.

We claim.

1. A display device including:

a plurality of generally vertical display racks forming a closed rectangular configuration having a plurality of vertical sides, each of said display racks including a front face for supporting display items, a rear face and vertical end walls, means for supporting each of said display racks for rotation between a first position wherein said front face of each of said display racks faces outwardly of said rectangular configuration for displaying the display items and wherein each of said vertical sides is formed by a front face of one of said display racks and an end wall of an adjacent display rack, and a second position wherein said front face of each of said display racks faces inwardly of said rectangular configuration, and means for connecting the display racks for simultaneous shifting movement from said first position to said second position.

2. A display device as set forth in claim 1 wherein said means for supporting said display racks for rotation includes pivot members pivotably supportin said display racks, said pivot members being located intermediate the opposite ends of said sides.

3. A display device as set forth in claim 2 wherein one of said pivot members is connected to each of said display racks adjacent one of said end walls and the other end wall of said each of said display racks is movable outwardly when said display rack moves from one of said positions to another of said positions.

4. A display rack as set forth in claim 2 wherein said means for connecting said display racks includes a first gear connected to a pivot member supporting a first one of said display racks and being rotatable with said one of said display racks, a second gear connected to a pivot member supporting a second one of said display racks and being rotatable with said second of said display racks, and a third gear between said first gear and said second gear and in driving engagement with said first gear and said second gear.

5. A display device as set forth in claim 1 wherein said display racks each include one end pivotably supported and an opposite end positioned adjacent a second of said display racks when said display rack is in said first position and adjacent a third display rack when said display rack is in said second position.

6. A display device as set forth in claim 5 wherein said opposite ends move outwardly and arcuately from said first position to said second position.

7. A display device as set forth in claim 1 and further including a vertical supporting shaft, a horizontal upper supporting plate supported by said vertical shaft, a lower horizontal supporting plate supported by said vertical shaft below said upper supporting plate, and means for pivotably supporting said display racks between said upper and lower supporting plates.

8. A display device as set forth in claim 7 wherein said means for pivotably supporting said display racks includes a plurality of pivot members supported by one of said supporting plates, each of said pivot members supporting a respective one of said display racks for pivotal movement.

9. A display rack as set forth in claim 8 wherein said means for connecting said display racks includes a first gear surrounding one of said pivot members and connected to a first one of said display racks for rotation with said first one of said display racks, said first one of said display racks being supported by said first one of said pivot members, a second gear surrounding a second one of said pivot members and connected to a second one of said display racks for rotation with said second one of said display racks, said second one of said display racks being supported by said second of said pivot members, and a third gear between said first gear and said second gear and in driving engagement with said first gear and said second gear.

10. A display rack as set forth in claim 9 wherein said third gear is supported for rotation around said vertical supporting shaft.

11. A display rack as set forth in claim 8 further including a tube surrounding said vertical supporting shaft and rotatable around said vertical supporting shaft, said tube supporting said supporting plates and said third gear, said third gear being rotatable around said tube.

12. A display rack as set forth in claim 11 further including means for locking said display racks in said second position, said locking means including means for preventing rotation of said gear with respect to said lower supporting plate.

13. A display device as set forth in claim 8 wherein said display racks form a closed rectangular configuration around said vertical supporting shaft, and wherein said display racks each include vertical side walls, each of said display racks being pivotable about a point adjacent one of said vertical side walls.

* * * * *